US008844288B2

(12) United States Patent
Nishimoto et al.

(10) Patent No.: US 8,844,288 B2
(45) Date of Patent: Sep. 30, 2014

(54) STEAM TURBINE FACILITY

(71) Applicant: Mitsubishi Heavy Industries, Ltd., Tokyo (JP)

(72) Inventors: Shin Nishimoto, Tokyo (JP); Katsuhisa Hamada, Tokyo (JP); Yoshinori Tanaka, Tokyo (JP); Tanehiro Shinohara, Tokyo (JP); Tetsuro Akamatsu, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 118 days.

(21) Appl. No.: 13/729,648

(22) Filed: Dec. 28, 2012

(65) Prior Publication Data

US 2014/0000258 A1 Jan. 2, 2014

(30) Foreign Application Priority Data

Jul. 2, 2012 (JP) ..... 2012-148725

(51) Int. Cl.

| | |
|---|---|
| ***F01K 13/02*** | (2006.01) |
| ***F01K 21/06*** | (2006.01) |
| ***F01K 21/00*** | (2006.01) |
| ***F01D 11/00*** | (2006.01) |

(52) U.S. Cl.

CPC ..... *F01K 21/00* (2013.01); *F01D 11/00* (2013.01)

USPC ..... 60/646; 60/657; 415/200

(58) Field of Classification Search

CPC ..... F01K 21/00; F01D 11/00

USPC ..... 60/643, 646, 657, 670; 415/146, 170.1, 415/200

See application file for complete search history.

(56) References Cited

U.S. PATENT DOCUMENTS

| | | | | |
|---|---|---|---|---|
| 4,646,782 | A * | 3/1987 | Ezekoye | 137/527.8 |
| 5,749,227 | A * | 5/1998 | Smith et al. | 60/657 |
| 7,021,632 | B2 * | 4/2006 | Grace | 277/395 |
| 2005/0220611 | A1 | 10/2005 | Bhate et al. | |
| 2011/0148094 | A1 * | 6/2011 | Asakura et al. | 285/41 |
| 2013/0001456 | A1 * | 1/2013 | Rayment et al. | 251/328 |
| 2013/0287549 | A1 * | 10/2013 | Mihara et al. | 415/146 |

FOREIGN PATENT DOCUMENTS

| | | |
|---|---|---|
| JP | 4-203205 | 7/1992 |
| JP | 6-8378 | 3/1994 |
| JP | 9-317894 | 12/1997 |
| JP | 9-324272 | 12/1997 |
| JP | 2003-120327 | 4/2003 |
| JP | 2005-291496 | 10/2005 |
| JP | 2010-43590 | 2/2010 |
| JP | 2010-144707 | 7/2010 |

OTHER PUBLICATIONS

International Search Report issued Jan. 22, 2013 in corresponding International Application No. PCT/JP2012/082846.

* cited by examiner

*Primary Examiner* — Hoang Nguyen

(74) *Attorney, Agent, or Firm* — Wenderoth, Lind & Ponack, L.L.P.

(57) ABSTRACT

A steam turbine facility is provided which is capable of appropriately sealing a gap between members made of cast material of Ni-based alloy even under the steam-temperature condition of 650° C. or higher, and which includes a first member and a second member whose base material is formed of cast material composed of at least one of Ni-based alloy, austenite steel, or high-chrome steel, form a space where the steam of 650° C. or higher flows. Between the first member and the second member, a metal gasket is provided which has a plurality of portions in line contact with the first member and the second member. On the first member and the second member, a first high-hardness layer which is harder than the base material, is provided at least in a portion where each of the first member and the second member is in line contact with the metal gasket.

8 Claims, 3 Drawing Sheets

STEAM TURBINE FACILITY

TECHNICAL FIELD

The present invention relates to a steam turbine facility in which steam whose temperature is 650° C. or higher is used.

BACKGROUND ART

In a steam turbine facility, steam is led from a boiler to a turbine casing via a pipe so as to drive the turbine by the steam. Further, a steam valve (a stop valve, a governing valve, etc) is provided in a steam pipe for supplying the steam to the turbine casing. The steam valve is configured to cut off the steam entering the turbine casing and to adjust the steam flow.

In a conventional steam turbine facility, a graphite type spiral-wound gasket was mainly used for a seal portion of a flange connection part of the pipes, the steam valve, and the like. The graphite type spiral-wound gasket, herein, indicates a semi-metallic gasket formed by alternately winding a metallic hoop and a filler of graphite-type material into a spiral shape.

For instance, described in Patent Literature 1 is a spiral gasket in which an expanded graphite tape containing inorganic oxidation inhibitor is used as filler to improve the maximum temperature of use in oxide atmosphere up to approximately 500° C.-600° C.

From the perspective of improving performance of steam turbine facilities, the temperature of the steam has been increased. A steam turbine facility where steam temperature is 650° C. or higher is becoming popular. In this type of steam turbine facility used under harsh steam-temperature conditions, when the graphite type spiral-wound gasket described in Patent Literature 1 is used, there is a concern about deterioration of sealability of the gasket due to loss of graphite by oxidation.

Described in Patent Literature 2 is a self-sealing gasket which can be used in the steam turbine facility under the harsh steam-temperature conditions (see paragraph 0015, Patent Literature 2). The cross-sectional shape of this self-sealing gasket is a circular ring with a slit. This self-sealing gasket seals a gap between a steam valve casing and a bonnet by being held between the steam valve casing and the bonnet and making line contact with them. When using the self-sealing gasket, steam passes through the slit and is guided into the gasket to apply an internal pressure of the steam to the gasket. As a result, even if a fastening force of the casing and the bonnet is small, it is possible to achieve excellent sealability with respect to high temperature and high pressure steam.

CITATION LIST

Patent Literature

[PTL 1]
JP 9-317894 A
[PTL 2]
JP 2010-043590 A

SUMMARY

Technical Problem

In a steam turbine facility where temperature of steam is 650° C. or higher, a base material of each component is made using cast material with excellent high-temperature strength, such as Ni-based alloy. Here, the cast material such as Ni-based alloy normally has excellent high-temperature strength and weldability and is inexpensive. Therefore, the cast material is suitable material as the base material of each component of the steam turbine facility which is exposed to high temperature steam. However, the cast material such as Ni-based alloys has low yield stress.

Therefore, when the self-sealing gasket of Patent Literature 1 is used in the steam turbine facility in which the base material of the component is made of cast material such as Ni-based alloy, the base material (cast material such as Ni-based alloy) is deformed by high contact pressure on a line-contact portion contacting the gasket. As a result, the sealability is deteriorated, which might lead to leak of the steam.

In view of the above issue, it is an object of at least one embodiment of the present invention to provide a steam turbine facility which is capable of appropriately sealing a gap between members made of cast material such as Ni-based alloy even under the steam-temperature condition of 650° C. or higher.

Solution to Problem

According to at least one embodiment of the present invention, a steam turbine facility in which steam having temperature of 650° C. or higher is used, comprises:

a first member and a second member whose base material is formed of cast material composed of at least one of Ni-based alloy, austenite steel, or high-chrome steel, the first member and the second member forming a space where the steam flows;

a metal gasket provided between the first member and the second member, the metal gasket having a plurality of portions in line contact with the first member and the second member; and a first high-hardness layer which is harder than the base material, the first high-hardness layer being provided on the first member and the second member at least in an area where each of the first member and the second member is in line contact with the metal gasket.

Further, the first high-hardness layer may be a high-hardness film formed on the base material of the first member and the second member by an arbitrary method such as thermal spraying, plating and build-up welding, or may be a high-hardness member that is formed separately from the base material of the first member and the second member and then attached to the base material, or may be a surface layer of the base material of the first member and the second member that is hardened by an arbitrary method such as nitriding and carburizing and quenching.

In at least one embodiment, the first high-hardness layer has approximately enough hardness to withstand the stress generated by the line contact with the metal gasket. As the material of the first high-hardness layer, Co-based alloy represented by Stellite® and Tribaloy®, high-hardness Ni-based alloy represented by Inconel 625® and Inconel 617®, chromium carbide, tungsten carbide, ceramics and cermets, etc. can be used.

In this steam turbine facility, the metal gasket is provided between the first member and the second member, instead of a graphite type spiral-wound gasket. Therefore, high sealability can be achieved even under the harsh steam-temperature condition of 650° C. or higher. Further, the first high-hardness layer that is harder than the base material (the cast material of Ni-based alloy or the like) is provided on at least the line-contact portions of the first member and the second member contacting the metal gasket. Therefore, it is possible to prevent deformation of the first member and the second member caused by high contact pressure on the line-contact portions contacting the metal gasket, thereby suppressing decline of sealability.

Therefore, even under the steam-temperature condition of 650° C. or higher, it is possible to appropriately seal a gap between the first member and the second member formed of cast material of Ni-based alloy or the like.

According to at least one embodiment, on an outer circumferential side of the metal gasket, an annular projection formed in the first member is fitted to an annular depression formed in the second member, the metal gasket is held between a projection seal surface formed on the annular projection and a depression seal surface formed on the annular depression to be in line contact with each of the projection seal surface and the depression seal surface, an outer circumference of the metal gasket is in line contact with a wall surface of the second member which forms an outer circumferential edge of the annular depression, and the first high-hardness layer is provided on the projection seal surface, the depression seal surface and the wall surface.

As the metal gasket contacts the first member and the second member at three portions in total (the projection seal surface of the first member, the depression seal surface of the second member and the wall surface of the second member forming the outer circumferential edge of the annular depression), it is possible to effectively suppress leak of the steam. Further, by providing the first high-hardness layer on those three line-contact portions of the first member and the second member contacting the metal gasket, it is possible to prevent deformation of the first member and the second member caused by high contact pressure on the line-contact portions contacting the metal gasket.

Moreover, the metal gasket may have a slit in cross-section, and the metal gasket may be arranged so that the slit faces toward the space and a portion other than the slit may be in line contact with the projection seal surface, the depression seal surface and the wall surface.

As described above, by arranging the metal gasket so that the slit faces toward the space (where the steam having the temperature of 650° C. or higher flows), the steam is introduced to the interior space of the metal gasket via the slit and this steam pushes the metal gasket against the line-contact portions contacting the first member and the second member with high contact pressure. More specifically, the metal gasket configured as described above can achieve high sealability owing to the self-seal function using the pressure of the steam.

On the other hand, when attempting to exhibit the self-seal function of the metal gasket using the pressure of the steam, even higher contact pressure is applied by the line-contact portions of the first member and the second member contacting the metal gasket and this causes the first member and the second member to be more likely to deform. However, by providing the first high-hardness layer on the line-contact portions between the first member and the second member contacting the metal gasket, it is possible to effectively suppress deformation of the first member and the second member.

Further, according to at least one embodiment, the first member contacts the second member in an annular area which is on an outer circumferential side of a fitting position where the annular projection is fitted to the annular depression, the first member being fastened to the second member in a fastening area which is on an outer circumferential side of the annular area, and a second high-hardness layer which is harder than the base material, is provided in a portion where the first member contacts the second member in the annular area.

By bring the first member into contact with the second member in the annular area which is on the outer circumferential side of the fitting position, a space is defined between the projection seal surface of the first member and the depression seal surface of the second member. As a result, simply by fastening the first member and the second member together in the fastening area, the space between the projection seal surface of the first member and the depression seal surface of the second member can be appropriately adjusted, and expected sealability of the metal gasket can be obtained. Further, it is possible to prevent generation of excessive contact pressure at the line-contact portions of the first member and the second member contacting the metal gasket. Further, by providing the second high-hardness layer on the portion where the first member contacts the second member in the annular area, it is possible to prevent deformation of the first member and the second member in the annular area even if the fastening force in the fastening area impinges on the annular area.

Furthermore, the second high-hardness layer may be made of material of the same kind with or a different kind from the first high-hardness layer. In at least one embodiment, the second high-hardness layer may have approximately enough hardness to withstand the stress generated by the contact between the first member and the second member in the annular area. As the material of the second high-hardness layer, Co-based alloy represented by Stellite® and Tribaloy®, high-hardness Ni-based alloy represented by Inconel 625® and Inconel 617®, chromium carbide, tungsten carbide, ceramics and cermets, etc. may be used for instance.

In one embodiment, one of the first member or the second member may be a valve casing of a steam valve, and the other of the first member or the second member may be a bonnet of the steam valve which is attached to the valve casing.

In another embodiment, the first member and the second member may form a flange connection part of a pair of pipes in which the steam flows.

In yet another embodiment, one of the first member or the second member may be an upper half of a turbine casing (an outer casing or an inner casing), and the other of the first member or the second member may be a lower half of the turbine casing.

A typical turbine casing is configured without a sealing mechanism such as a gasket and the upper half and the lower half are joined together by metal touch at a horizontal parting plane. One of the reasons is that it is difficult to produce the graphite type spiral-wound gasket, which has been used as the sealing mechanism of the steam valve, in a size large enough to seal the turbine casing which is larger in size than the steam valve. On the other hand, the above metal gasket is easier to produce in larger size compared to the graphite type spiral-wound gasket. Thus, by providing the above metal gasket between the upper half and the lower half of the turbine casing, the sealability of the turbine casing can be improved.

Advantageous Effects

According to at least one embodiment of the present invention, instead of a graphite type spiral-wound gasket, the metal gasket is provided between the first member and the second member. Therefore, high sealability can be achieved even under the harsh steam condition of 650° C. or higher. Further, the first high-hardness layer that is harder than the base material (the cast material of Ni-based alloy or the like) is provided on at least the line-contact portions of the first member and the second member contacting the metal gasket. Therefore, it is possible to prevent deformation of the first member and the second member caused by high contact pressure on the line-contact portions contacting the metal gasket, thereby suppressing decline of sealability.

Therefore, even under the steam-temperature condition of 650° C. or higher, it is possible to appropriately seal a gap between the first member and the second member formed of cast material of Ni-based alloy or the like.

DETAILED DESCRIPTION

Embodiments of the present invention will now be described in detail with reference to the accompanying drawings. It is intended, however, that unless particularly specified, dimensions, materials, shape, relative positions and the like of components described in these embodiments shall be interpreted as illustrative only and not limitative of the scope of the present invention.

Figure 1:
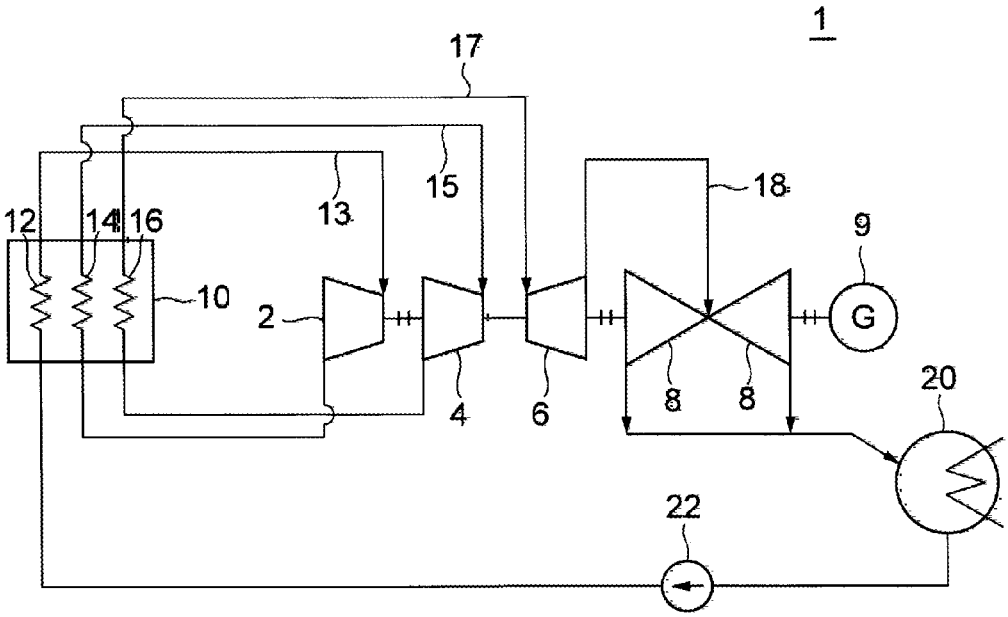
FIG. 1 is an illustration of an overall structure of a steam turbine facility according to one embodiment.

FIG. 1 is an illustration of an overall structure of a steam turbine facility according to one embodiment.

In one embodiment, a steam turbine facility 1 is provided with a turbine group formed by a very high pressure turbine 2, a high pressure turbine 4, an intermediate pressure turbine 6 and a low pressure turbine 8, a generator 9 driven by the turbine group, and a boiler 10 for producing steam to be supplied to the turbine group.

Further, shafts of the very high pressure turbine 2, the high pressure turbine 4, the intermediate pressure turbine 6 and the low pressure turbine 8 may be coupled to each other on the same axis and may also be coupled to a shaft of the generator 9.

Main steam is produced in a superheater 12 installed in the boiler 10. The main steam produced in the superheater 12 is supplied to the very high pressure turbine 2 via a main steam pipe 13. The main steam supplied to the very high pressure turbine 2 performs expansion work and is then discharged from the very high pressure turbine 2 to a first reheater 14 installed in the boiler 10. The steam reheated in the first reheater 14 enters the high pressure turbine 4 via a first reheat steam pipe 15. Then the reheat steam supplied to the high pressure turbine 4 performs expansion work and is discharged from the high pressure turbine 4 to a second reheater 16 installed in the boiler 10. The reheat steam reheated in the second reheater 16 enters the intermediate pressure turbine 6 via a second reheat steam pipe 17. Then, the reheat steam supplied to the intermediate pressure turbine 6 performs expansion work and is discharged from the intermediate pressure turbine 6 to the low pressure turbine 8 via a crossover pipe 18. Then, the steam supplied to the low pressure turbine 8 performs expansion work and is discharged from the low pressure turbine 8 to a condenser 20 to be condensed and then returned to the boiler 10 by a boiler feed water pump 22.

In the steam turbine facility 1 configured as described above, the main steam supplied to the very high pressure turbine 2 via the main steam pipe 13, the reheat steam supplied to the high pressure turbine 4 via the first reheat steam pipe 15, and the reheat steam supplied to the intermediate pressure turbine 6 via the second reheat steam pipe 17 have temperature of 650° C. or higher (e.g. approximately 700° C.). Further, a pressure of the main steam is set to 30 MPa or higher, e.g. 35 MPa.

In the steam turbine facility 1, a steam valve such as a stop valve and a governing valve is provided in each of the main steam pipe 13, the first reheat steam pipe 15, and the second reheat steam pipe 17.

Figure 2:
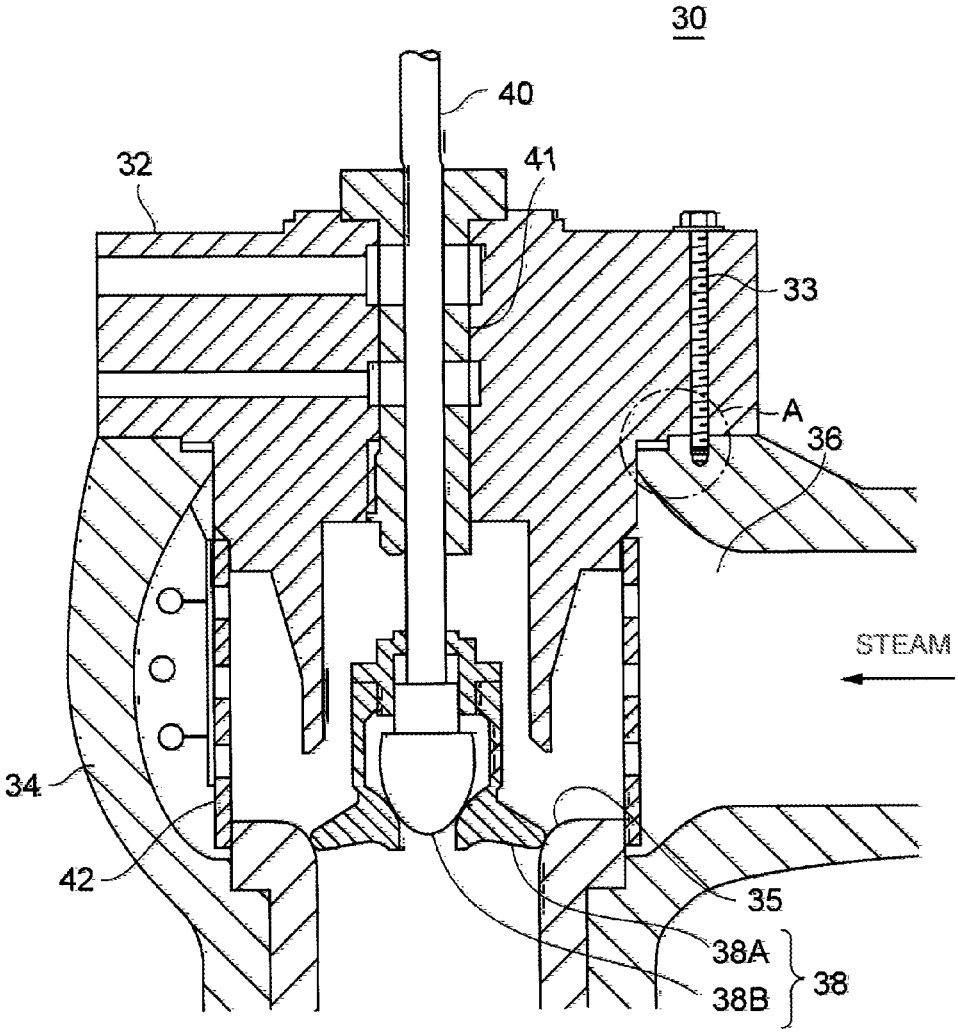
FIG. 2 is a cross-sectional view of an exemplary configuration of a steam valve of the steam turbine facility.
Figure 3:
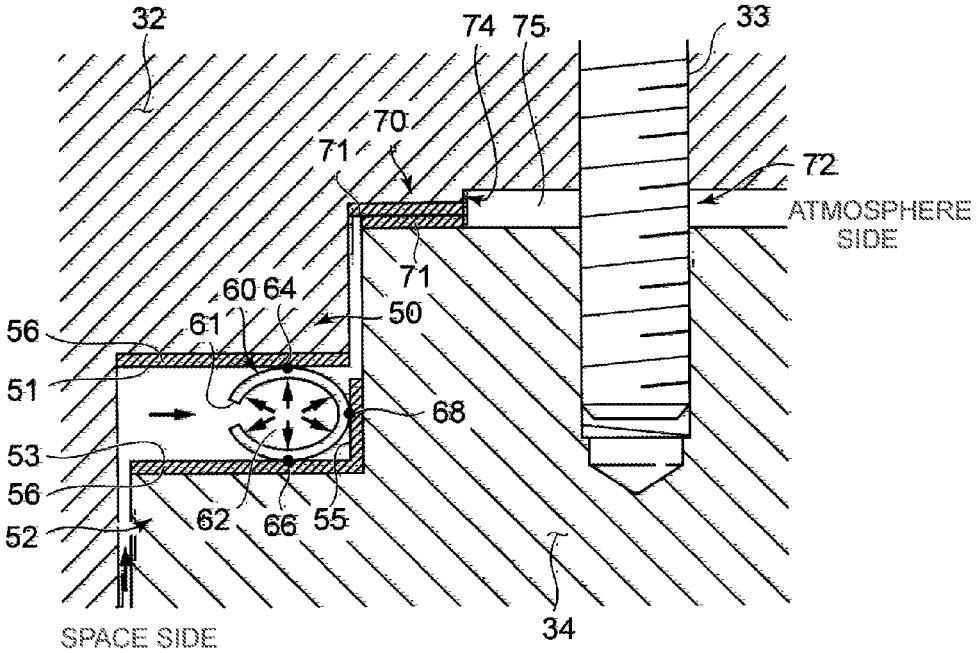
FIG. 3 is an enlarged view of section A of FIG. 2.

FIG. 2 is a cross-sectional view of an exemplary configuration of the steam valve of the steam turbine facility 1. FIG. 3 is an enlarged view of section A of FIG. 2.

As illustrated in FIG. 2, the steam turbine 30 is configured so that a valve element 38 is housed in a valve chamber 36. The valve chamber 36 is formed by a bonnet 32 and a valve casing 34. The bonnet 32 and the valve casing 34 are made of cast material composed of at least one of Ni-based alloy, austenite steel, high-chrome steel (containing 9 to 12% of chrome). This cast material is hereinafter referred to as "the cast material of Ni-based alloy or the like". The bonnet 32 is fastened to the valve casing 34 by a fastening member 33.

The valve element 38 is formed by a main valve 38A and a subvalve 38B enclosed in the main valve 38A. The main valve 38A is provided to face a valve seat 35 of the valve casing 34. A valve rod 40 is attached to the subvalve 38B. Via the valve rod 40, a driving force of an actuator (not shown) is transmitted. The valve rod 40 slides in a guide bush 41 provided in the bonnet 32. The subvalve 38B attached to the valve rod 40 is configured to move back and force alone up to a certain lift amount but move with the main valve 38A past the certain lift amount. On an outer circumference of the valve element 38, a cylindrical strainer 42 is provided to remove foreign objects contained in the steam.

Described in reference to FIG. 3 is a structure of the gasket for sealing the steam of 650° C. or higher in each part of the steam turbine facility 1.

In the steam turbine facility 1, a peripheral structure of the gasket for sealing the part where the steam having temperature of 650° C. or higher flows are common. Therefore, hereinafter, when explaining the peripheral structure of the gasket in reference to FIG. 3, the bonnet 32 is generalized as "a first member 32" and the valve casing 34 is generalized as "a second member 34".

One example besides the steam valve 30, to which the peripheral structure of the gasket described below is applicable, is a flange connection part in the steam pipe such as the main steam pipe 13, the first reheat steam pipe 15 and the second reheat steam pipe 17 of the steam turbine facility 1. In this case, the first member 32 is a flange part (a first flange part) of one of the pipes and the second member 34 is a flange part (a second flange part) of the other of the pipes which is connected to the first flange part. Further, the first flange part and the second flange part are joined at a flange joint plane and are fastened to each other so as to form a space where the steam having temperature of 650° C. or higher flows.

As another example, the peripheral structure of the gasket described below may be applied to a turbine casing (an outer casing or an inner casing) of such as the very high pressure turbine 2, the high pressure turbine 4 and the intermediate pressure turbine 6 of the steam turbine facility 1. In this case, one of the first member 32 or the second member 34 is an upper half of the turbine casing and the other of the first member 32 or the second member 34 is a lower half of the turbine casing. Further, the upper half and the lower half of the turbine casing are fastened together at a horizontal parting plane so as to form a space where the steam having temperature of 650° C. or higher flows.

As illustrated in FIG. 3, an annular projection 50 formed in the first member 32 is fitted to an annular depression 52 formed in the second member 34. A projection seal surface 51 of the annular projection 50 of the first member 32 and a depression seal surface 53 of the annular depression 52 of the second member 34 are positioned opposite to each other. Between the projection seal surface 51 and the depression seal surface 53, a metal gasket 60 is provided.

The metal gasket 60 has an annular shape continuing in the circumferential direction along the annular projection 50 and the annular depression 52. The cross-section of the metal gasket 60 has an approximately C-shape with a slit 61. The slit 61 is provided on an inner circumferential side of the metal gasket 60 and faces toward the space formed by the first member 32 and the second member 34 (e.g. the valve chamber 36 in the steam valve 30). Therefore, the high pressure steam is introduced from the space (e.g. the valve chamber 36) into an interior space 62 of the metal gasket 60. The metal gasket 60 being subjected to the internal pressure expands. In this manner, the steam introduced to the interior space 62 through the slit 61 pushes the metal gasket 60 against the first member 32 and the second member 34. Therefore, the metal gasket 60 can achieve high sealability owing to the self-seal function using the pressure of the steam.

Further, the material of the metal gasket 60 is not particularly limited as long as it can withstand the condition where the temperature of the steam is 650° C. For instance, Ni-based alloy having high degree of hardness may be selected as the material of the metal gasket 60. The metal gasket 60 is typically made of material that is harder than the base material (the cast material of Ni-based alloy or the like) of the first member 32 and the second member 34.

The metal gasket 60 having the above structure is arranged between the projection seal surface 51 and the depression seal surface 53. In this state, by fastening the fastening member 33, the metal gasket 60 is pressed by the projection seal surface 51 and the depression seal surface 53 to be compressed in the height direction (in the vertical direction in FIG. 3). As a result, the metal gasket 60 expands in the lateral direction. In this process, the outer circumference of the metal gasket 60 contacts a wall surface 55 of the second member 34 which forms an outer circumferential edge of the annular depression 52.

Therefore, the metal gasket 60 is in line contact with the first member 32 or the second member 34 at total three line-contact portions 64, 66, and 68. More specifically, the top of the metal gasket 60 is in line contact with the projection seal surface 51 on the first member 32 side at the line-contact portion 64; the bottom of the metal gasket 60 is in line contact with the depression seal surface 53 on the second member 34 side at the line-contact portion 66; and the outer circumference of the metal gasket 60 is in line contact with the wall surface 55 of the second member 34 which forms the outer circumferential edge of the annular depression 52 at the line-contact portion 68.

By bringing the metal gasket 60 into line contact with the first member 32 and the second member 34 at those total three line-contact portions 64, 66, and 68, the metal gasket 60 is surely appressed to the first member 32 and the second member 34 so as to effectively suppress leak of the steam.

On the first member 32 and the second member 34, a first high-hardness layer 56 is provided on at least the line-contact portions (64, 66, and 68) contacting the metal gasket 60. As a result, it is possible to prevent deformation of the first member 32 and the second member 34 caused by high contact pressure on the line-contact portions 64, 66, and 68 contacting the metal gasket 60, thereby preventing leak of the steam.

Further, the first hardness layer 56 may be provided, as illustrated in FIG. 3, over the entire projection seal surface 51 on the first member 32 side and depression seal surface 53 on the second member 34 side in a large area including the line-contact portions 64, and 66. Furthermore, the first high-hardness layer 56 provided on each of the line-contact portions 64, 66, and 68 may be made of material of the same kind or of different kind.

The high-hardness layer 56 is made of material that is harder than the base material of the first member 32 and the second member 34 (the cast material of Ni-based alloy or the like). As the material of the first high-hardness layer 56, Co-based alloy represented by Stellite® and Tribaloy®, high-hardness Ni-based alloy represented by Inconel 625® and Inconel 617®, chromium carbide, tungsten carbide, ceramics and cermets, etc. can be used.

The first high-hardness layer 56 may be a high-hardness film formed on the base material of the first member 32 and the second member 34 by an arbitrary method such as thermal spraying, plating and build-up welding, or may be a high-hardness member that is formed separately from the base material of the first member 32 and the second member 34 and then attached to the base material, or may be a surface layer of the base material of the first member 32 and the second member 34 that is hardened by an arbitrary method such as nitriding and carburizing and quenching.

In at least some embodiments, the first member 32 contacts the second member 34 in an annular area 70 which is on the outer circumferential side of a fitting position, where the annular projection 50 is fitted to the annular depression 52, and the first member 32 is fastened to the second member 34 by the fastening member 33 in a fastening area 72 which is on the outer circumferential side of the annular area 70.

By bringing the first member 32 and the second member 34 into contact with each other in the annular area 70 on the outer circumferential side of the fitting position of the annular projection 50 and the annular depression 52, a space is defined between the projection seal surface 51 and the depression seal surface 53 that are arranged on the inner circumferential side of the annular area 70. As a result, simply by fastening the first member 32 and the second member 34 together in the fastening area 72, the space between the projection seal surface 51 of the first member 32 and the depression seal surface 53 of the second member 34 can be appropriately adjusted and expected sealability of the metal gasket 60 can be obtained. Further, it is possible to prevent generation of excessive contact pressure at the line-contact portions (64, 66, and 68) of the second member 34 and the first member 32 of the metal gasket 60.

A second high-hardness layer 71 may be provided in each portion where the first member 32 contacts the second member 34 in the annular area 70. The second high-hardness layer 71 is made of material that is harder than the base material of the first member 32 and the second member 34 (the cast material of Ni-based alloy or the like). By providing the second high-hardness layer 71 in the portion of the annular area 70, where the first member 32 contacts the second member 34, it is possible to prevent deformation of the first member 32 and the second member 34 in the annular area 70 even if the fastening force of the fastening member 33 in the fastening area 72 impinges on the annular area 70.

As the material of the second high-hardness layer 71, Co-based alloy represented by Stellite® and Tribaloy®, high-hardness Ni-based alloy represented by Inconel 625® and Inconel 617®, chromium carbide, tungsten carbide, ceramics and cermets, etc. can be used.

The second high-hardness layer 71 may be a high-hardness film formed on the base material of the first member 32 and the second member 34 by an arbitrary method such as thermal spraying, plating and build-up welding, or may be a high-hardness member that is formed separately from the base material of the first member 32 and the second member 34 and then attached to the base material, or may be a surface layer of the base material of the first member 32 and the second member 34 that is hardened by an arbitrary method such as nitriding and carburizing and quenching.

In the periphery of the fastening area 72, a stepped portion 74 may be formed in the first member 32 or the second member 34 to form a space 75 between the first member 32 and the second member 34.

By providing the space 75 in the periphery of the fastening area 72, large compressive force can be applied to the metal gasket 60 when fastening the fastening member 33. This improves the contact property between the metal gasket 60 and the first member 32 or the second member 34 at the line-contact portions 64, 66, and 68. As a result, it is possible to improve sealability of the metal gasket 60.

As described above, in at least one embodiment of the present invention, the metal gasket 60 is provided between the first member 32 and the second member 34, instead of a graphite type spiral-wound gasket. Therefore, high sealability can be achieved even under the harsh steam condition of 650° C. or higher. Further, the first high-hardness layer 56 that is harder than the base material (the cast material of Ni-based alloy or the like) is provided on at least the line-contact portions 64, 66, and 68 of the first member 32 and the second member 34 contacting the metal gasket 60. Therefore, it is possible to prevent deformation of the first member 32 and the second member 34 caused by high contact pressure on the line-contact portions 64, 66, and 68 contacting the metal gasket 60, thereby suppressing decline of sealability. By preventing leak of the steam, it is possible to improve reliability of the steam turbine facility 1 and also to prolong the service life of the steam turbine facility 1.

Therefore, even under the steam-temperature condition of 650° C. or higher, it is possible to appropriately seal a gap between the first member 32 and the second member 34 whose base material is formed of cast material of Ni-based alloy or the like.

While the embodiments of the present invention have been described, it is obvious that the present invention is not limited thereto, and various modifications and changes may be made without departing from the scope of the invention.

For instance, in some of the above-described embodiments, the annular projection 50 is formed in the first member 32 while the annular depression 52 is formed in the second member 34. However, this is not limitative and the annular depression 52 may be formed in the first member 32 while the annular projection 50 may be formed in the second member 34.

In some of the above-described embodiments, a description has been given of the example where the metal gasket 60 which has the slit 61 in cross section is used. However, the shape of the metal gasket provided between the first member 32 and the second member 34 is not limited to this example and a metal gasket of various shape may be used.

Figure 4:
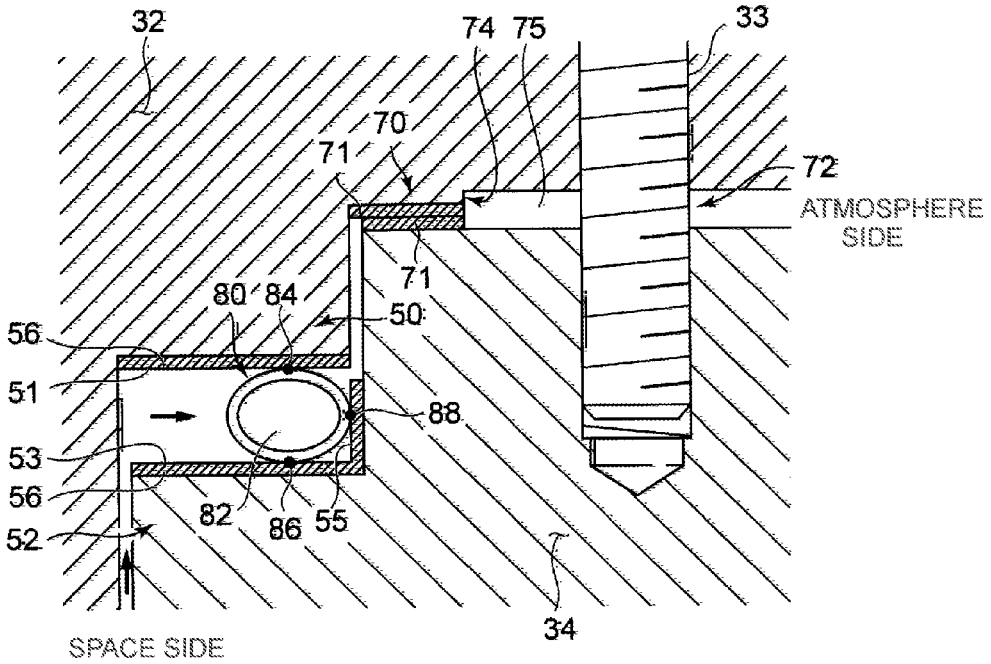
FIG. 4 is an illustration of a metal gasket shaped differently from that in FIG. 3 and provided between a first member and a second member.

FIG. 4 is an illustration of an example of a metal gasket having another shape and provided between the first member 32 and the second member 34. Further, the peripheral structure of the metal gasket illustrated in FIG. 4 is the same as the above embodiments and thus the same reference numerals are given without adding explanations for those configurations that are common with the above embodiments.

As illustrated in FIG. 4, the metal gasket 80 has an annular shape continuous in the circumferential direction along the annular projection 50 and the annular depression 52. The metal gasket 80 is a hollow O-ring having a hollow part 82. The metal gasket 80 is arranged between the projection seal surface 51 and the depression seal surface 53. In this state, by fastening the fastening member 33, the metal gasket 80 is pressed by the projection seal surface 51 and the depression seal surface 53 to be compressed in the height direction (in the vertical direction in FIG. 4). As a result, the metal gasket 80 expands in the lateral direction. In this process, the outer circumference of the metal gasket 80 contacts the wall surface 55 of the second member 34 which forms the outer circumferential edge of the annular depression 52. Therefore, the metal gasket 80 is in line contact with the first member 32 or the second member 34 at total three line-contact portions 84, 86, and 88. More specifically, the top of the metal gasket 80 is in line contact with the projection seal surface 51 on the first member 32 side at the line-contact portion 84; the bottom of the metal gasket 80 is in line contact with the depression seal surface 53 on the second member 34 side at the line-contact portion 86; and the outer circumference of the metal gasket 80 is in line contact with the wall surface 55 of the second member 34 which forms the outer circumferential edge of the annular depression 52 at the line-contact portion 88.

Further, the material of the metal gasket 80 is not particularly limited as long as it can withstand the condition where the temperature of the steam is 650° C. For instance, Ni-based alloy having high degree of hardness may be selected as the material of the metal gasket 80. The metal gasket 80 is typically made of material that is harder than the base material (the cast material of Ni-based alloy or the like) of the first member 32 and the second member 34.

The invention claimed is:

1. A steam turbine facility in which steam having temperature of 650° C. or higher is used, the steam turbine facility comprising:

a first member and a second member whose base material is formed of cast material composed of at least one of Ni-based alloy, austenite steel, or high-chrome steel, the first member and the second member forming a space where the steam flows;

a metal gasket provided between the first member and the second member, the metal gasket having a plurality of portions in line contact with the first member and the second member; and a first high-hardness layer which is harder than the base material, the first high-hardness layer being provided on the first member and the second member at least in a portion where each of the first member and the second member is in line contact with the metal gasket.

2. The steam turbine facility according to claim 1, wherein on an outer circumferential side of the metal gasket, an annular projection formed in the first member is fitted to an annular depression formed in the second member, wherein the metal gasket is held between a projection seal surface formed on the annular projection and a depression seal surface formed on the annular depression to be in line contact with each of the projection seal surface and the depression seal surface, wherein an outer circumference of the metal gasket is in line contact with a wall surface of the second member which forms an outer circumferential edge of the annular depression, and wherein the first high-hardness layer is provided on the projection seal surface, the depression seal surface and the wall surface.

3. The steam turbine facility according to claim 2, wherein the metal gasket has a slit in cross-section, and wherein the metal gasket is arranged so that the slit faces toward the space and a portion other than the slit is in line contact with the projection seal surface, the depression seal surface and the wall surface.

4. The steam turbine facility according to claim 2, wherein the first member contacts the second member in an annular area which is on an outer circumferential side of a fitting position where the annular projection is fitted to the annular depression, the first member being fastened to the second member in a fastening area which is on an outer circumferential side of the annular area, and wherein the steam turbine facility further comprises:

a second high-hardness layer which is harder than the base material, the second high-hardness layer being provided in a portion where the first member contacts the second member in the annular area.

5. The steam turbine facility according to claim 1, wherein the first high-hardness layer is formed of Co-based alloy.

6. The steam turbine facility according to claim 1, wherein one of the first member or the second member is a valve casing of a steam valve, and wherein the other of the first member or the second member is a bonnet of the steam valve which is attached to the valve casing.

7. The steam turbine facility according to claim 1, wherein the first member and the second member form flange connection parts of a pair of pipes in which the steam flows.

8. The steam turbine facility according to claim 1, wherein one of the first member or the second member is an upper half of a turbine casing, and wherein the other of the first member or the second member is a lower half of the turbine casing.

* * * * *